US009868921B2

(12) United States Patent
Sanchez et al.

(10) Patent No.: US 9,868,921 B2
(45) Date of Patent: Jan. 16, 2018

(54) LUBRICANT DESIGN MANUFACTURABILITY PROCESS

(71) Applicants: Eugenio Sanchez, Pitman, NJ (US); Diane L. Hymas, Pitman, NJ (US); Charles L. Baker, Jr., Thornton, PA (US)

(72) Inventors: Eugenio Sanchez, Pitman, NJ (US); Diane L. Hymas, Pitman, NJ (US); Charles L. Baker, Jr., Thornton, PA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 436 days.

(21) Appl. No.: 14/477,934

(22) Filed: Sep. 5, 2014

(65) Prior Publication Data

US 2015/0094242 A1 Apr. 2, 2015

Related U.S. Application Data

(60) Provisional application No. 61/885,189, filed on Oct. 1, 2013.

(51) Int. Cl.
*C10M 169/04* (2006.01)
*G01N 31/00* (2006.01)
(Continued)

(52) U.S. Cl.
CPC ..... *C10M 177/00* (2013.01); *C10G 2400/10* (2013.01); *C10M 2205/026* (2013.01);
(Continued)

(58) Field of Classification Search
CPC ..... C10N 2220/022; G01N 30/8624; G01N 21/274
(Continued)

(56) References Cited

U.S. PATENT DOCUMENTS 3,826,904 A 7/1974 Leonard et al.
6,295,485 B1 9/2001 Gleeson et al.
(Continued)

FOREIGN PATENT DOCUMENTS

JP 2011168655 A 9/2011
WO 2006/062885 A2 6/2006
WO 2006/062885 A3 6/2006

OTHER PUBLICATIONS

The partial International Search Report of PCT/US2014/055741 dated Jan. 14, 2015.
(Continued)

*Primary Examiner* — Vishal Vasisth
(74) *Attorney, Agent, or Firm* — Scott F. Yarnell; Robert A. Migliorini

(57) ABSTRACT

Methods are provided for designing a blending component for making a plurality of lubricant products that contain the designed blending component. This can be accomplished by first determining a plurality of manufacturability index values for each desired lubricant product for a family of proposed blending components. The manufacturing index values can then be used to construct a manufacturability window for each lubricant product. The manufacturability windows for each lubricant product can then be analyzed to determine regions of overlap, if any, where a proposed blending component can be used with an increased likelihood to formulate each of the desired products. Alternatively, manufacturability windows can be used to determine suitability of pre-existing blending components for formulation of desired products.

18 Claims, 3 Drawing Sheets

(51) Int. Cl.

| | |
|---|---|
| ***G01B 3/44*** | (2006.01) |
| ***H03F 1/26*** | (2006.01) |
| ***H04B 15/00*** | (2006.01) |
| ***C10M 177/00*** | (2006.01) |

(52) U.S. Cl.
CPC ..... *C10M 2205/028* (2013.01); *C10M 2205/0265* (2013.01); *C10M 2205/0285* (2013.01); *C10N 2230/02* (2013.01); *C10N 2230/04* (2013.01); *C10N 2230/06* (2013.01); *C10N 2230/10* (2013.01); *C10N 2230/54* (2013.01); *C10N 2230/74* (2013.01); *C10N 2270/00* (2013.01)

(58) Field of Classification Search
USPC ..... 508/110; 702/22, 25, 34, 189
See application file for complete search history.

(56) References Cited

U.S. PATENT DOCUMENTS

| | | | | |
|---|---|---|---|---|
| 7,684,933 | B2 | 3/2010 | Gao et al. | |
| 2010/0077842 | A1* | 4/2010 | Rosenbaum ..... | G01N 33/26 73/54.01 |

OTHER PUBLICATIONS

The International Search Report and Written Opinion of PCT/US20141055741 dated Mar. 6, 2015.
Mason, Robert L., "Developing Prediction Equations for Fuels and Lubricants," SAE Technical Papers, 1981.
Van Dam, W. et al., "The Impact of Lubricant Viscosity and Additive Chemistry on Fuel Economy in Heavy Duty Diesel Engines," SAE International Journal of Fuels and Lubricants, 2012, vol. 5, issue 1, pp. 459-469.
Neveu, Christian D. et al., "Development of a Statistical Method to Formulate High-VI Hydraulic Oils," Lubrication Science, 2001, vol. 14, issue 1, pp. 57-71.
Bourgognon, H. et al., "Mathematical Model for the Thickening Power of Viscosity Index Improvers: Application to Engine Oil Formulations," Lubrication Science, 1991, vol. 3, issue 3, pp. 143-160.
Wu, G. et al., "Formulating additive recipe with the aid of expert system in the blending of 15W/40CD grade diesel engine oil," Petroleum Processing and Petrochemicals, 1999, vol. 30, issue 2, pp. 47-51 (in Chinese with English abstract).
Huang, H. et al., "Mathematical models for the blending of engine lube (lubricating) base oil," Acta Petrolei Sinica (Petroleum Processing Section), 1994, vol. 10, issue 1, pp. 79-87 (in Chinese with English abstract).
Sun, Z. et al., "Study on the BP neural network of the lubricating oil blending," Jisuanji Yu Yingyong Huaxue, 2002, vol. 19, pp. 81-85 (in Chinese with English abstract).
Liu, Christopher S. et al., "Optimizing Dispersants in a Lubricant Formulation by Statistical Design—A Simplex Model," SAE International Fuels & Lubricants Meeting, 1992.
Roegiers, Michel et al., "Property blending relationships for binary mixtures of mineral oil and elektrionised vegetable oil: viscosity, solvent power, and seal compatibility index," Lubrication Science, 2011, vol. 23, pp. 263-278.
Yamamoto, Roy I. et al., "Statistical Design of an API SG Dispersant," SAE International Fuels and Lubricants Meeting, 1992.

* cited by examiner

LUBRICANT DESIGN MANUFACTURABILITY PROCESS

CROSS-REFERENCE TO RELATED APPLICATIONS

This application claims priority to U.S. Provisional Application Ser. No. 61/885,189 filed Oct. 1, 2013, which is herein incorporated by reference in its entirety.

FIELD

Methods are provided for designing a lubricant blending component to allow for manufacture of lubricant products.

BACKGROUND

Formulation of lubricant products from various base stocks and other blend components has traditionally consisted of a trial and error process. Some modeling techniques are available that can offer predictions regarding the properties of a lubricant product based on the weight percentage of various components in a proposed product. However, actual industry practice still centers on testing of a variety of blends to determine the appropriate composition of a desired product.

U.S. Pat. No. 7,684,933 provides an example of a method for predicting the properties of a finished lubricant product based on the blend components used to formulate the product. Various types of model functions are used to predict a variety of properties for a lubricant product based on the properties of the blend components. This can allow for selection of blend components that reduce or minimize the cost of producing the desired lubricant product.

SUMMARY

In an aspect, a method for designing a lubricant blending component is provided. The method includes identifying a plurality of lubricant products for formulation using a plurality of formulation components, the plurality of formulation components for each lubricant product including a first blending component; selecting at least one first property of the first blending component; varying the at least one first property of the first blending component to have a first plurality of selected values; calculating a manufacturability index value for each of the plurality of lubricant products at each of the first plurality of selected values, the calculated manufacturability index values for each lubricant product corresponding to a manufacturability window; determining an overlap between the manufacturability windows for each lubricant product; and formulating the plurality of lubricant products using the first blending component, the first blending component having a value for the at least one selected first property within the determined overlap of the manufacturability windows.

In another aspect, a method for selecting a lubricant blending component is provided. The method includes identifying a plurality of lubricant products for formulation using a blending component from a family of blending components; calculating a manufacturability index value for each of the plurality of lubricant products using each blending component from the family of blending components; selecting a blending component from the family of blending components based the calculated manufacturability index values; and formulating the plurality of lubricant products using the selected blending component. Optionally, the family of blending components can correspond to a family of additives. Optionally, the family of blending components can correspond to a slate of lubricant base stocks.

DETAILED DESCRIPTION

Figure 1:
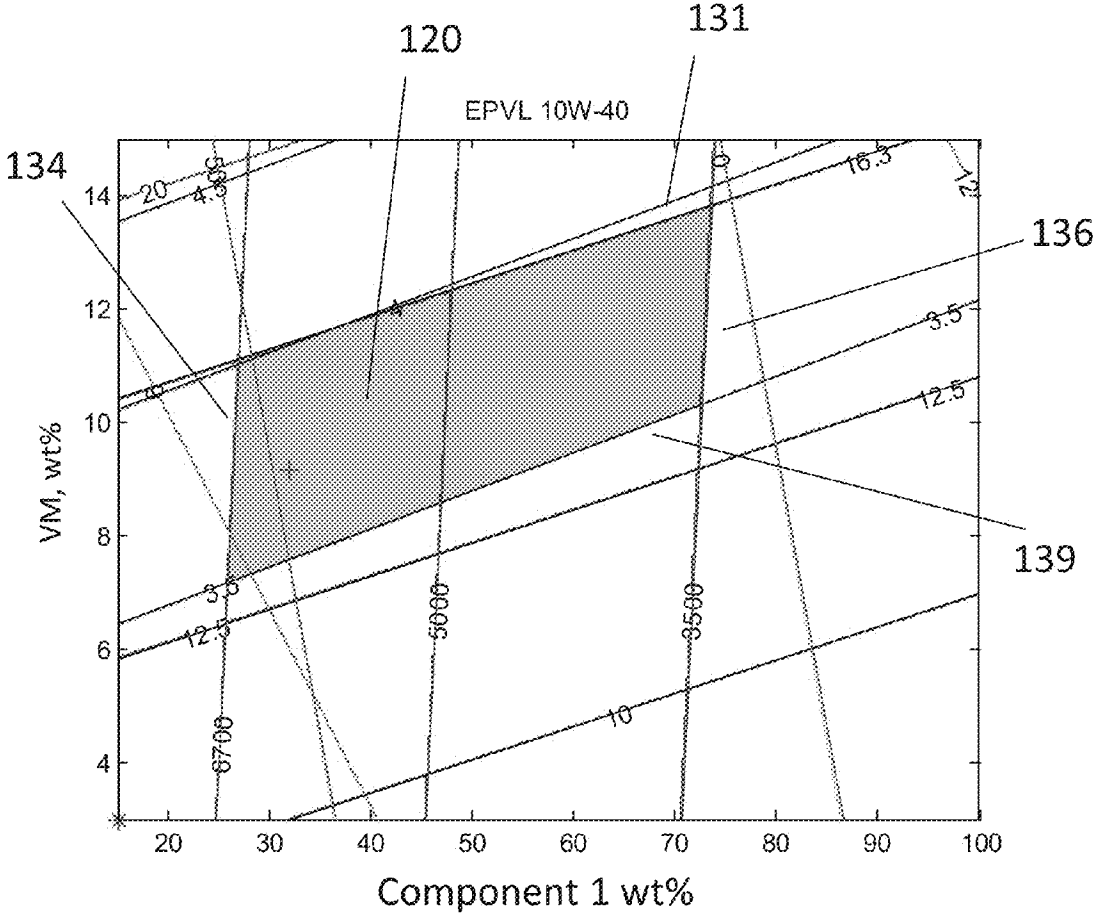
FIG. 1 depicts an example of a chart showing a region for calculation of a manufacturing index for a lubricant product.

All numerical values within the detailed description and the claims herein are modified by "about" or "approximately" the indicated value, and take into account experimental error and variations that would be expected by a person having ordinary skill in the art.

Overview

In various embodiments, methods are provided for designing a blending component for making a plurality of lubricant products that contain the designed blending component. Rather than using a pre-determined group of blending components to produce a desired lubricant product, the methods described herein can be used to design a blending component that is suitable for producing a plurality and/or slate of lubricant products. Such a designed blending component can correspond to a base stock from a family of lubricant base stocks, an additive from a family of additives, or any other convenient blending component for formulating a lubricant product. In some aspects, this is accomplished by first determining a plurality of manufacturability index values for each desired lubricant product for a family of proposed blending components. The manufacturing index values can then be used to construct a manufacturability window for each lubricant product. The manufacturability windows for each lubricant product can then be analyzed to determine regions of overlap, if any, where a proposed blending component can be used with an increased likelihood to formulate each of the desired products.

In some alternative aspects, manufacturing index values can be calculated for a plurality of blending components, such as a plurality of different additives. The plurality of blending components can correspond to pre-existing components, such as commercially available additives or slates of base stocks. The manufacturing index values for each blending component for each lubricant product can then be compared to identify the blending component with the largest manufacturing index values, or the fewest values below a threshold, or the values that match another criteria for selecting a blending component.

As noted above, production of lubricant products from a collection of possible blending components is conventionally a trial and error process. Although modeling techniques are available for predicting the properties of a lubricant product based on a proposed mixture of blending components, trial and error testing is still used to identify new blending components. A recent paper on formulation of lubricant base oils for heavy duty diesel engines describes examples of trial and error investigation of the impact of blending components on formulated products. (See *The impact of lubricant viscosity and additive chemistry on fuel economy in heavy duty diesel engines*, van Dam et al., SAE International Journal of Fuels and Lubricants, v. 5, n. 1, p 459-469 (2012).) In spite of such ongoing research, there is a long felt need in the art for a system or method that would allow design of new blending components while reducing or minimizing the amount of trial and error testing needed for designing the blending component. For example, research into how to predict the properties of a lubricant product based on the blending components has been ongoing since the 1980's. (See, for example, *Developing Prediction Equations for Fuels and Lubricants*, Robert L. Mason, SAE Technical Papers, 1981.)

From a practical standpoint, the use of trial and error methods for lubricant product design has been due in part to the nature of commercial production of lubricant products. The typical producer of lubricant products will have an initial selection of blending components that the producer will use to make a plurality of lubricant products offered by that producer. One or more of the blending components can correspond to base stocks from a slate of lubricant base stocks. Particularly for base stocks used as blending components, the producer will desire to have base stocks that can be used to formulate a plurality of finished products, such as some or all of the products in a family of products offered by a producer. Because the blending components are used to produce a variety of lubricant products, any changes to the blending components currently require extensive trial and error testing to determine whether the producer can still manufacture the full group of desired lubricant products using the changed blending component(s).

Instead of the conventional trial and error process, in various aspects methods are provided for determining whether a proposed design for a blending component will be suitable for formulating a plurality of lubricant products, such a blending component corresponding to a base stock from a slate of lubricant base stocks. First, a set of proposed properties for the proposed blending component can be determined. For example, the desire to develop a new base stock for use as a blending component may be based on a desire to have a blending component with a different volatility, a different viscosity, or a different value for some other desirable property in a lubricant product. Optionally, selecting one or more properties for the proposed blending component can determine other required values for additional properties of the blending component. After determining the proposed set of one or more properties, a manufacturability window is determined for making each lubricant product in a plurality of desired lubricant products using the proposed blending component.

The manufacturability window is determined by calculating a series of manufacturability index values for the proposed blending component. The series of manufacturability index values are calculated based on varying the one or more selected properties of the proposed component. As one example, a series of manufacturability index values can be calculated based on variations in two properties, such as Noack volatility and cold crank simulator viscosity at −25° C. In other aspects, the series of manufacturability index value can be based on variations in a single property or in a plurality of properties.

After determining a manufacturability window for each lubricant product, the manufacturability windows can be analyzed to determine where an overlap exists between the manufacturability windows for the plurality of lubricant products. The region of overlap between the manufacturability windows represents ranges for the selected one or more properties that can allow manufacture of the plurality of lubricant products. Based on this, values can be selected for the one or more properties for the proposed blending component so that a suitable blending component is made without having to perform extensive trial and error testing.

In this description, a "blending component" is defined as a lubricant base stock or a lubricant additive, such as a viscosity modifier, that is used to formulate a lubricant product. It is understood that a lubricant base stock used as a blending component can represent a base stock formed directly from refining of an initial crude feed, a pre-defined mixture of base stocks formed from multiple refining processes, or any other type of base stock that is suitable for use in formulating a lubricant product. Optionally, a lubricant base stock used as a blending component can be a base stock from a slate of lubricant base stocks. Similarly, a lubricant additive can be any type of additive or pre-defined mixture of additives suitable for use in producing a lubricant product.

In this description, a "formulation component" corresponds to a blending component that is allowed to vary in concentration as part of the determination of the manufacturability index value for a lubricant product. For example, consider a lubricant product that is formulated using two base stock blending components and two additives. In this example, one of the additives is always added at a fixed level, such as 0.1 wt %. The second additive is allowed to vary between 2 and 5 wt %. The two base stock blending components are varied in a reciprocal manner, with an increase in one base stock leading to a corresponding decrease in the other. The ratio of the two base stock blending components is maintained when the amount of the second additive is varied. In this example, the two base stocks and the second additive correspond to "formulation components", as the amounts of the two base stocks and the second additive are allowed to vary in determining the manufacturability window for the lubricant product. In this example, one of the two base stock blending components can correspond to the blending component that is being designed. The other base stock and the second additive correspond to additional formulation components.

In this description, a "manufacturability index" is a characteristic value of a region in a multi-dimensional space. The number of dimensions in the multi-dimensional space corresponds to the number of dimensions that can be independently varied in the blending component. Based on the definition of a "formulation component" above, the number of dimensions for the multi-dimensional space or region associated with a manufacturability index will usually be the number of formulation components minus one. For example, in the example noted above involving three formulation components, there are only two degrees of freedom that can be independently varied. Thus, the multi-dimensional space associated with the manufacturability index will be a two dimensional space. For such a two-dimensional space, the manufacturability index can be a characteristic value corresponding to an area of the two-dimensional space, or corresponding to a length that is characteristic of the two-dimensional space, such as a minimum value along a dimension or another defined axis. Similarly, the multi-dimensional space for an example involving four formulation components will correspond to a three-dimensional space, or a volume. The associated manufacturability index can then be a characteristic value corresponding to a volume, an area, a length, or another characteristic of the three-dimensional space. Those of skill in the art will understand that still larger numbers of formulation components (that can be individually varied) will lead to larger numbers of dimensions for the manufacturability window.

It is noted that the number of blending components is not necessarily related to the dimensions for the multi-dimensional space associated with a manufacturing index, as an arbitrary number of blending components with fixed concentrations can be included in a proposed product. Such blending components with fixed concentrations do not contribute a degree of freedom in determining the composition of the lubricant product, and therefore do not increase the number of dimensions in the multi-dimensional space.

In this description, a "manufacturing window" represents a window for a lubricant product that is defined based on a series of manufacturing index values, where the manufacturing index values are calculated based on variations in one or more properties for a proposed blending component. It is noted that the number of dimensions for a manufacturing window does not have to be related to the number of dimensions for the multi-dimensional space associated with a manufacturing index. For example, a proposed blending component may be desired that provides improved values for Noack volatility and a viscosity, such as a cold crank simulator viscosity at −25° C. In this example, the manufacturing window is a 2-dimensional window. The number of formulation components used for determining the series of manufacturing index values is not related to determining the number of dimensions for the manufacturing window. In this example, if the proposed blending component includes 5 formulation components, the multi-dimensional space associated with each manufacturing index value will be a 4-dimensional space.

Blending Components

Any convenient type of base stock or additive can be used as a blending component, and optionally as a formulation component. With regard to base stocks, suitable base stocks can be characterized in any convenient way. For example, some base stocks can be characterized as Group I, Group II, or Group III base stocks. Group I base stocks or base oils are defined as base oils with less than 90 wt % saturated molecules and/or at least 0.03 wt % sulfur content. Group I base stocks also have a viscosity index (VI) of at least 80 but less than 120. Group II base stocks or base oils contain at least 90 wt % saturated molecules and less than 0.03 wt % sulfur. Group II base stocks also have a viscosity index of at least 80 but less than 120. Group III base stocks or base oils contain at least 90 wt % saturated molecules and less than 0.03 wt % sulfur, with a viscosity index of at least 120. In addition to the above formal definitions, some Group I base stocks may be referred to as a Group I+ base stock, which corresponds to a Group I base stock with a VI value of 103 to 108. Some Group II base stocks may be referred to as a Group II+ base stock, which corresponds to a Group II base stock with a VI of at least 113. Some Group III base stocks may be referred to as a Group III+ base stock, which corresponds to a Group III base stock with a VI value of at least 140.

Suitable additives can include any convenient type of additive, such as viscosity modifier additives, detergents or dispersants, solubility modifiers, volatility modifiers, or any other conventional type of additive for a lubricant product. Lubricant additives or components include, but are not limited to, viscosity modifiers, dispersants, detergents, pour point depressants, oil thickeners, polyisobutylenes, high molecular weight polyalphaolefins, antiwear/extreme pressure agents, antioxidants, demulsifiers, seal swelling agents, friction modifiers, corrosion inhibitors, and antifoam additives, as well as performance packages containing mixtures of these lubricant additives, such as for example mixtures of dispersants, detergents, antiwear/extreme pressure agents, antioxidants, demulsifiers, seal swelling agents, friction modifiers, corrosion inhibitors, antifoam additives, and pour point depressants. High viscosity lubricants include, but are not limited to, viscosity modifiers, pour point depressants, dispersants, polyisobutylenes, and high molecular weight polyalphaolefins and additive packages containing one or more of these high viscosity lubricants. In some aspects, blending of lubricant additives can be performed using positive-displacement liquid-handling equipment method to allow blending to be performed with minimal chemical, thermal or physical degradation of the high viscosity lubricant components within the lubricant blend.

With regard to a proposed blending component, the proposed blending component can be varied or selected in any convenient manner to determine manufacturing index values. For example, for a proposed base stock blending component can be varied by varying one or more properties of the proposed base stock. This variation can correspond, for example, to variations in the base stock property within a range that matches a known or tested range of variation for the proposed base stock, such as a range that can be achieved by incorporating an additive into the base stock. Examples of properties of a proposed base stock that can be varied or selected include, but are not limited to, viscosity related properties, such as kinematic viscosity at a defined temperature, cold crank simulator viscosity at a defined temperature, or high temperature high shear viscosity; volatility related properties, such as Noack volatility, or a desired boiling point profile; compositional properties, such as the amount of saturates, naphthenes, sulfur, or nitrogen in the base stock, or an average molecular weight of the base stock; or any other convenient property that can be characterized and controlled when producing a lubricant base stock for use as a blending component.

As another example, for a proposed blending component that is an additive, a series of manufacturing index values can be generated for a plurality of additives that perform a similar function in order to determine the additive with the largest manufacturing index value. For example, a series of viscosity modifiers can be tested to generate manufacturing index values for each viscosity modifier in each lubricant product. In this type of aspect, the group of manufacturing index values for each viscosity modifier (or other additive) can be compared to determine the viscosity modifier that provides a manufacturing index value greater than a threshold value for the largest number of products; or to determine the viscosity modifier that has the minimum number of manufacturing index values less than a second threshold value; or any other convenient method can be used for comparing the manufacturing index values between additives.

Modeling of Product Properties

In various aspects, the properties of a lubricant product can be determined based on the properties of the blending components used to formulate the lubricant product. Various models can be used to determine the properties of the lubricant product based on the blending components. For example, some properties for a product can be determined based on a weighted average of the property for each blending component in the product. Other properties may have a non-linear relationship, so that the functional form for the value of the product property is a weighted average of the logarithm of the property values for each blending component. Still other properties can be calculated based on any convenient functional form for combining the properties of the blending components in a manner that accounts for the amount of a blending component in the composition.

More generally, the value of a property $P_p$ for a lubricant product can be expressed relative to the values $P_i$ for the property for each component i, present in an amount $X_i$ (wt %):

$$T(P_p)=\Sigma(i)[X_i*T(P_i)] \quad (1)$$

where T is any convenient functional form, such as a polynomial function, a logarithmic function, an exponential function, or a combination thereof. Of course, a simple version of equation (1) is the version corresponding to a weighted average, as shown in (2):

$$P_p=\Sigma(i)[X_i*P_i] \quad (2)$$

Manufacturability Index

In various aspects, determining a plurality of manufacturability index values for a plurality of proposed blending components provides the basis for designing or selecting an appropriate blending component or plurality of blending components. A manufacturability index value provides a measure of the likelihood or reliability of being able to produce a given lubricant product based on a formulation that includes one or more proposed blending components with a selected set of properties.

To determine a manufacturability index value, the composition and/or properties of the proposed blending component are selected. This can correspond to selecting one or more property or composition values for the proposed blending component from a potential range of values. Alternatively, this can correspond to selecting a specific additive from a group of additives with similar functionality.

In some aspects, manufacturability index values can be determined based on selection of the composition and/or properties for a plurality of blending components. Optionally, when the composition and/or properties are selected for a plurality of blending components, one or more of the blending components can correspond to lubricant base stocks from a slate of lubricant base stocks. A base stock slate is a product line of base stocks that have different viscosities but are in the same base stock grouping, and typically from the same manufacturer. For example, in order to maintain a desired blending relationship between base stocks in a base stock slate, a change in a selected property for a first base stock from a base stock slate may result in a need to change the selected property in one or more other base stocks in the slate. Alternatively, selection of the composition and/or properties for more than one blending component at the same time can correspond to a selection of composition and/or properties for otherwise unrelated blending components.

In addition to selecting the properties of the proposed blending component(s), the other blending components in the lubricant product are also defined. This can include fixing the amount of some blending components, while other blending components are treated as formulation components that can have varying amounts within the lubricant product. Selecting the properties for the blending component, defining the amount of the blending components that are present in a fixed amount in the lubricant product, and defining the blending components that correspond to formulation components that can vary in amount, allows for determination of a manufacturing index value.

To determine the manufacturing index value, a region in a multi-dimensional space is identified where the combination of the blending components is calculated to provide a product that meets a plurality of desired specifications for a lubricant product. As noted above, the multi-dimensional space is defined by the number of formulation components in the lubricant product. The property specifications for the lubricant product can include any property of a product that can be characterized, such as volatility, viscosity, or compositional properties.

After identifying the region in the multi-dimensional space where all of the product specifications are satisfied, a manufacturability index value can be determined. In some aspects, the manufacturing index value can correspond to a minimum dimension or another characteristic distance for the region. For example, the manufacturability index value can correspond to the allowed variation (such as in wt %) for the component with the smallest amount of allowed variation. In other aspects, the manufacturability index value can correspond to a product of multiple dimensions, such as an amount of multi-dimensional space enclosed by the region, or an amount of lower-dimensional space defined by a subset of the dimensions for the region. For example, a lubricant product containing 5 formulation components will have a region in a 4-dimensional space that corresponds to the region where all product specifications are satisfied. The enclosed 4-dimensional "volume" within the region can correspond to a manufacturability index. Alternatively, a manufacturability index could be defined based on the product of the two shortest dimensions for the region, or defined based on the average dimension value for each of the 4 dimensions defining the region, or based on any other convenient way of using the values that define the enclosed region.

The manufacturability index value represents an amount of tolerance the lubricant product has for variations in the relative amounts of the formulation components. Because theoretical methods are not exact, the calculated properties for a lubricant product may vary from the corresponding actual properties of a formulated lubricant product at a given composition. The manufacturability index value represents a tolerance for such differences in calculated and actual values. Thus, if the manufacturability index value is greater than a threshold value, such as greater than about 1.0 wt % along a dimension corresponding to a formulation component, there is a reduced likelihood that errors in property calculation models will cause a predicted lubricant product to be within specifications when there is no combination of the formulation components that will actually lead to a product within specifications. More generally, the dimensions corresponding to a formulation component can correspond to any convenient type of value. Thus, a dimension can correspond to a weight percentage, a volume percentage, another relative fractional amount compared to one or more components within a composition, an absolute weight, an absolute volume, or a property derived based on the amount of the formulation component. For example, the viscosity for a combination of two base stocks may vary based on the relative amount of each base stock in the combination. Instead of using the fractional amount of one of the base stocks as the dimension, the viscosity could be used as the dimension.

As another Example, FIG. 1 shows a plot used for determining the manufacturability index for a proposed blending component for making a lubricant product. In the example for FIG. 1, the formulation components for the lubricant product are a viscosity modifier and two base stocks. One of the base stocks corresponds to the proposed blending component. In FIG. 1, the horizontal axis shows the relative ratio of the two base stocks, while the vertical axis shows the wt % of the viscosity modifier in the lubricant product. Because there are three formulation components, there are two degrees of freedom for the multi-dimensional space associated with this manufacturability index. Thus, the region where the lubricant product specifications are satisfied in this example will correspond to a 2-dimensional area.

In this example, the specifications for the lubricant product include specifications for an SAE J300 viscosity grade of a 10W-40 motor oil. These specifications include limits in kinematic viscosity at 100° C. (13.5 cSt<kV100<16.3 cSt), high temperature high shear viscosity at 150° C. (HTHS>3.5 cP), and cold crank simulator viscosity at −25° C. (3500<CCS@−25° C.<7000).

As shown in FIG. 1, the various kinematic viscosity limits, high temperature high shear viscosity limits, and cold crank simulator viscosity limits define a region (2-dimensional area) 120 where the lubricant product specifications are satisfied by various amounts of the viscosity modifier and the two base stocks. The region 120 is defined by an upper bound 131 corresponding mostly to a kV100 value of 16.3 cSt, except for at the left edge where the upper bound 131 corresponds to an HTHS of 4.0 cP; a lower bound 139 corresponding to an HTHS of 3.5 cP; and side bounds 134 and 136 corresponding to cold crank simulator viscosities at 25° C. of 6700 and 3500, respectively.

Based on this region, several options are available for defining a manufacturability index. One option is to define a manufacturability index based on the shortest dimension for the region. In FIG. 1, this corresponds to the dimension for the viscosity modifier. At the right hand edge of the region corresponding to side bound 136, the amount of the viscosity modifier can vary by about 1.8 wt %. Thus, a manufacturability index can be 1.8. Such a manufacturability index could then be compared to a threshold value for addition of viscosity modifier. For example, a threshold value to allow for variations between model behavior and actual behavior could be a value of 1.0 wt % along any dimension. The manufacturability index of 1.8 shown in FIG. 1 would satisfy such a threshold.

Another option is to define a manufacturability index value based on the area of the region 120. This can correspond to a situation where an overall tolerance is important, as opposed to a tolerance in variation for a single component.

For determining a manufacturability index value, the dimensions can be scaled in any convenient manner. In the example in FIG. 1, the dimensions are scaled based on a weight percentage of each independently varied component in the lubricant product. Alternatively, a scaling factor can be used for one or more of the dimensions in order to achieve a desired relationship or relationships between the dimensions.

Figure 2:
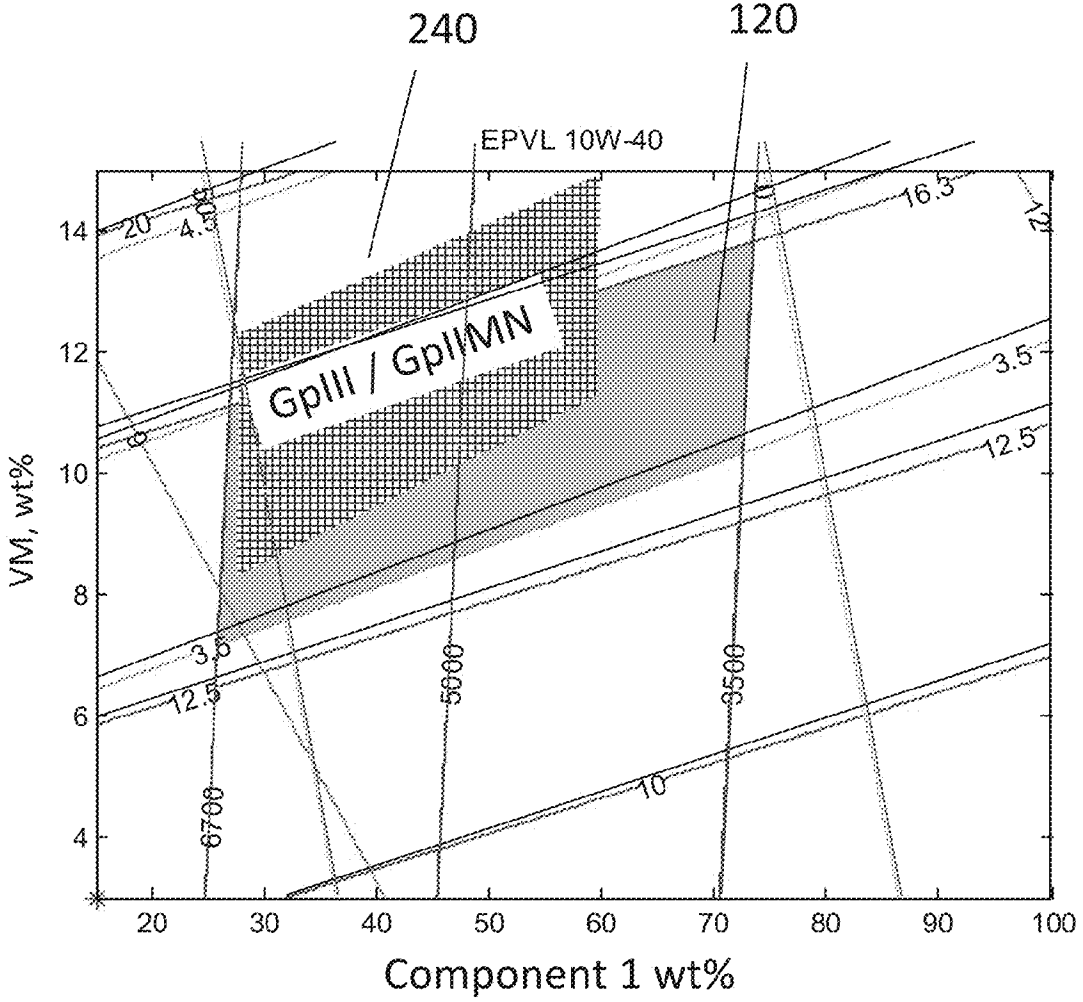
FIG. 2 depicts an example of a chart showing a region for calculation of a manufacturing index for a lubricant product.

FIG. 2 shows an example of another potential benefit of determining the manufacturability index for a lubricant product based on selected formulation components. In FIG. 2, a region 240 satisfying all lubricant product specifications is shown for a combination of two commercially available base stocks. The two commercially available base stocks are a Group III base stock and a Group II base stock. The plot in FIG. 2 allows for a direct comparison of the manufacturing index values for using the two different sets of formulation components to form the lubricant product. First, the formulation components including the proposed blending component provide a larger area 120 that meets the product specifications, as compared to the area 240 for the commercially available base stocks. Additionally, the area 240 for the commercially available base stocks generally corresponds to use of larger amounts of the viscosity modifier additive, as compared to the formulation including the proposed blending component.

Manufacturability Window

Based on the above, a manufacturability index value can be determined for a lubricant product based on a selected group of properties for the proposed blending component. One or more properties of the proposed blending component(s) can be varied in order to determine manufacturability index values for a family of related proposed blending components. This can be used to identify a manufacturability window for the proposed blending component relative to the lubricant product.

The manufacturability window corresponds to a family of proposed blending components having one or more properties within a specified range of values, where the family of proposed blending components all have a manufacturability index value greater than a desired threshold. As noted above, the manufacturability index values represent a tolerance value to reduce the likelihood that errors in the property calculation models will lead to an incorrect prediction about the actual ability to meet product specifications using the selected formulation components. Thus, the manufacturability window represents a family of proposed blending components that have an increased likelihood of being able to produce a lubricant product having the desired product specifications.

Application to Formulation of Multiple Lubricant Products

Based on the above, a manufacturability window can be determined for a lubricant product. Such a manufacturability window can also be determined for a plurality of lubricant products, in order to identify overlap between the manufacturability windows. The regions of overlap correspond to property values for a proposed blending component that can allow all products in a desired group of products to be produced. In aspects where multiple blending components are modified, the regions of overlap correspond to property values for the plurality of blending components (such as multiple base stocks from a slate of lubricant base stocks) that can allow a group of desired products to be produced.

Figure 3:
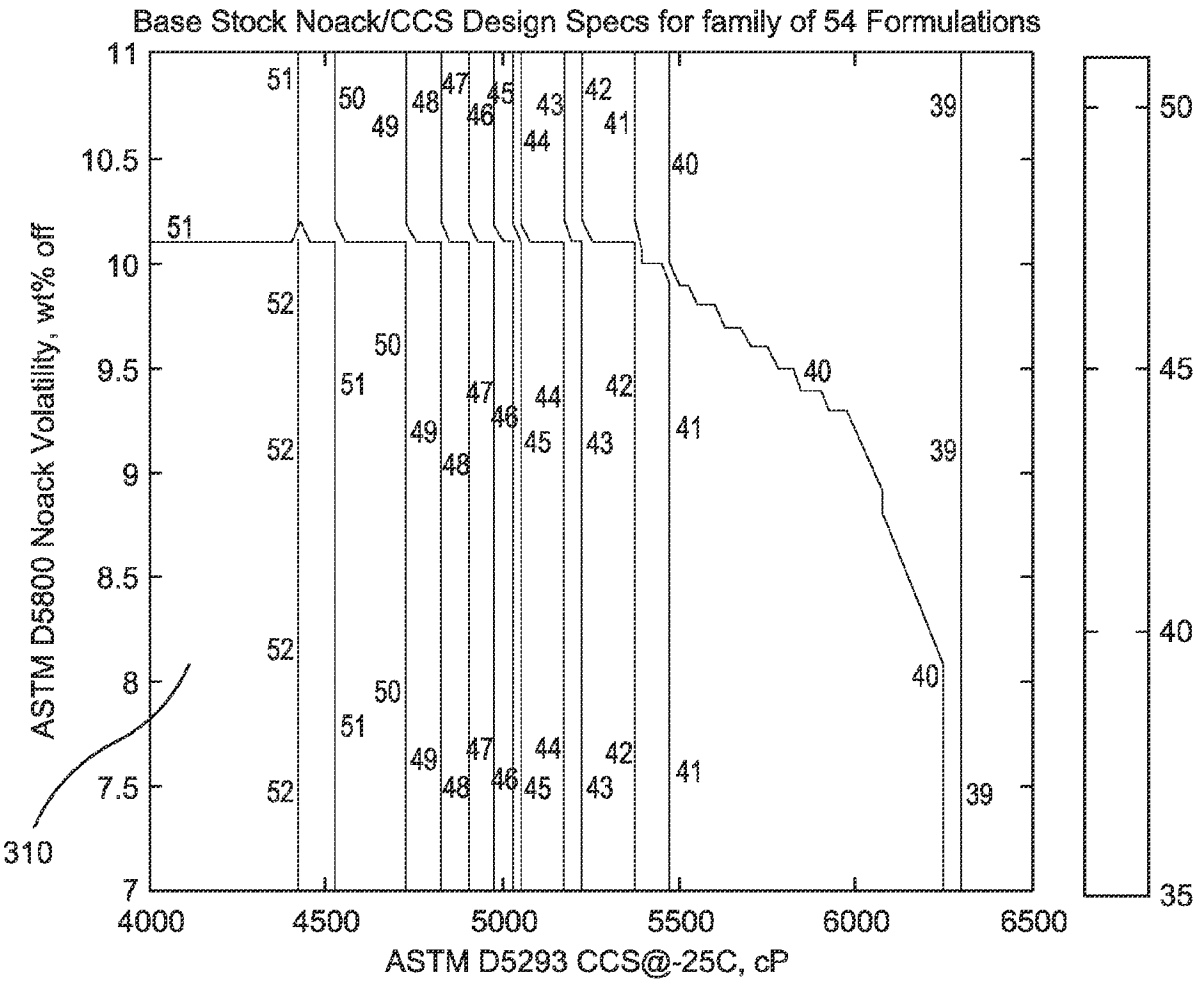
FIG. 3 depicts an example of a chart showing manufacturing windows for a plurality of lubricant products.

FIG. 3 shows an example of determining the overlap between manufacturability windows for a plurality of lubricant products that can be formed from a proposed blending component. In FIG. 3, the proposed blending component is a base stock that is intended for use in 54 different lubricant products. FIG. 3 shows the overlap in manufacturability window based on variations in the Noack volatility and the cold crank simulation viscosity at −25° C. for a family of proposed blending components. The area 310 in the left hand portion of the FIG. 3 corresponds to a region where all 54 of the lubricant products have a manufacturing index above a threshold value. As lines are crossed moving up or to the right within the manufacturability window plot in FIG. 3, successively fewer of the lubricant products in the desired plurality of products have a manufacturability index greater than the desired threshold. It is noted that having a manufacturability index value below the desired threshold for a given combination of proposed blending component and lubricant product does not mean that the lubricant product cannot be made. Instead, the manufacturability window shows the region with increased probability of being able to formulate the full range of desired products, or alternatively regions with increased probability of being able to form a subset of the range of desired products.

Examples of Design of Blending Component

In addition to lubricant base stocks, additive components of any functional family can also be designed using manufacturability window. For example, components with functionalities such as antiwear, antioxidants, antifoaming, viscosity modifiers, dispersants, thickeners, detergents, etc. can be modified in their basic parameters to impact finished lubricant performance. Based on such modification, the manufacturability window under a suitable set of performance constraints can be determined for one or more additive components. These parameters may not only have independent impact on the finished lubricant performance, but they may also have linear or non-linear interaction effects with other blending components that may need to be taken into account in the suitable models.

In a possible embodiment of the present disclosure, for a viscosity modifier additive, the molecular weight distribution, including the average molecular mass and the polydispersity can be independently varied. Using a suitable model of lubricant performance as a function of these variables for this viscosity modifier, a family of manufacturability windows can be determined for the manufacture of single product, a family of products, or an entire supply chain of engine and industrial lubricant products. The performance can be viscometric (e.g., kinematic viscosity, cold crank simulator viscosity, high temperature high shear), volatility (e.g., Noack), oxidation stability (e.g., RPVOT ASTM D2272, TOST D943 or Seq IIIg oxidation stability test), Fuel Economy, etc. The parameters of the viscosity modifier need not be limited to just molecular weight, but any other suitable design parameters such as type (olefin copolymers, styrene-diene copolymers, polymethacrylates, polyisobutylenes, etc), diluent oil types, or polymer properties such as shear stability, thickening efficiency, etc.

In another embodiment of the present disclosure, for a dispersant, the molecular weight distribution, the type of dispersant, the relative sizes of the polar versus non-polar ends, the relative dispersancy capacity, and other key dispersant properties can be independently varied. Using a suitable model of lubricant performance as a function of these variables for the dispersant, a family of manufacturability windows can be determined for the manufacture of a single product, a family of products, or an entire supply chain of engine and industrial lubricant products. Similar to the viscosity modifier case, the performance can be viscometric, volatility, oxidation stability, fuel economy, etc, or it can be related to deposit formation control, relative sludge formation control dispersancy, soot control, increased additive solubility, and other dispersant related performance.

In another embodiment of the present disclosure, for a detergent, the molecular weight distribution, the chemistry type (e.g., Salycilates, Phenates, Sulfonates, etc, salts of Calcium, or Magnesium, etc), relative total base number (TBN), total neutral soap content, and other key detergency variables can be independently varied. Using a suitable model of lubricant performance as a function of these variables for the detergent, a family of manufacturability windows can be determined for the manufacture of a single product, a family of products, or an entire supply chain of engine, or industrial lubricant products. Similar to the cases above, the finished lubricant performance can be viscometric, volatility, oxidation stability, fuel economy, etc, or it can be related to deposit formation control, existing deposit removal, engine combustion acid product neutralization, solubility, and other detergent related performance.

In another embodiment of the present disclosure, a combination of the properties of different additive performance properties can be varied at the same time, Using suitable models of lubricant performance, manufacturability windows can be determined that simultaneously capture the performance variations of two or more additives, to establish an overall manufacturability metric for the varying combinations. For example, the molecular weight of a viscosity modifier, its treat rate, and the design viscosities of a light neutral and a heavy neutral base stock can all be varied at the same time, in a model predicting the viscometric, volatility, and fuel economy characteristics of a family of finished engine oils. Manufacturability windows establishing the engine oil grade, desired maximum Noack volatility, and minimum fuel efficiency can be determined for each formulation, enabling the simultaneous design of the viscosity modifier, and the two base stocks in a slate.

In still another embodiment of the present disclosure, the manufacturability windows for a family of products can be determined for a plurality of already available components. The relative manufacturability indexes can then be compared so that the correct family of components can be chosen for manufacture of that family of products. For example, the manufacturability indexes for a family of engine oil products can be determined against a large set of base stock slates available in the marketplace, using suitable models that predict the desired performance characteristics of those lubricants. The desired variables to be varied can include the treat rates of the light and heavy base stocks used to make the blends within each slate. For a family with N formulations, and a comparison of M base stock slates, a total of N×M manufacturability windows can be established, and collapsed to the intersections of the N-sets in each slate, to a final set of M manufacturability windows and indexes. The slates can then be ranked according to their desirability based on the determined manufacturability windows.

ADDITIONAL EMBODIMENTS

Embodiment 1

A method for designing a lubricant blending component comprising: identifying a plurality of lubricant products for formulation using a plurality of formulation components, the plurality of formulation components for each lubricant product including a first blending component; selecting at least one first property of the first blending component; varying the at least one first property of the first blending component to have a first plurality of selected values; calculating a manufacturability index value for each of the plurality of lubricant products at each of the first plurality of selected values, the calculated manufacturability index values for each lubricant product corresponding to a manufacturability window; determining an overlap between the manufacturability windows for each lubricant product; and formulating the plurality of lubricant products using the first blending component, the first blending component having a value for the at least one selected first property within the determined overlap of the manufacturability windows.

Embodiment 2

The method of Embodiment 1, wherein the first blending component is selected from lubricant base stocks, viscosity modifiers, dispersants, detergents, pour point depressants, oil thickeners, polyisobutylenes, high molecular weight polyalphaolefins, antiwear/extreme pressure agents, antioxidants, demulsifiers, seal swelling agents, friction modifiers, corrosion inhibitors, antifoam additives, and combinations thereof.

Embodiment 3

The method of Embodiment 1 or Embodiment 2, further comprising: selecting at least one second property of a second blending component; and varying the at least one second property of the second blending component to have a second plurality of selected values, the manufacturability index values being calculated at one or more of the second plurality of values for each of the first plurality of selected values.

Embodiment 4

The method of any of the above Embodiments, wherein at least one of the first blending component and the second blending component comprises a lubricant base stock from a slate of base stocks.

Embodiment 5

The method of any of the above Embodiments, wherein at least one of the first blending component and the second blending component comprises an additive.

Embodiment 6

A method for selecting a lubricant blending component, comprising: identifying a plurality of lubricant products for formulation using a blending component from a family of blending components; calculating a manufacturability index value for each of the plurality of lubricant products using each blending component from the family of blending components; selecting a blending component from the family of blending components based the calculated manufacturability index values; and formulating the plurality of lubricant products using the selected blending component.

Embodiment 7

The method of Embodiment 6, wherein the family of blending components comprises a plurality of additives.

Embodiment 8

The method of Embodiment 7, wherein the plurality of additives are viscosity modifiers, dispersants, detergents, or a combination thereof.

Embodiment 9

The method of Embodiment 6, wherein the family of blending components comprises at least one lubricant base stock from a slate of lubricant base stocks.

Embodiment 10

The method of Embodiment 6, wherein the family of blending components comprises a slate of lubricant base stocks.

Embodiment 11

The method of any of the above Embodiments, wherein the manufacturability index value is based on a smaller number of dimensions than the region associated with manufacturability index.

Embodiment 12

The method of any of the above Embodiments, wherein the manufacturability index value for at least one lubricant product has a value of at least 0.5 along each of at least two dimensions.

Embodiment 13

The method of any of the above Embodiments, wherein the manufacturability index value for each lubricant product has a range value of at least 0.5 along each of at least two dimensions.

Embodiment 14

The method of any of the above Embodiments, wherein the range value along each of at least two dimensions is normalized so that a range value of 1.0 corresponds to 1.0 wt % of a corresponding additional formulation component in a lubricant product.

Embodiment 15

The method of any of the above Embodiments, wherein the at least one first property comprises a plurality of properties.

Embodiment 16

The method of any of the above Embodiments, wherein the plurality of formulation components comprises at least 4 formulation components for at least one lubricant product.

Embodiment 17

The method of any of the above Embodiments, wherein the manufacturability index value is a characteristic value corresponding to a region defined based on amounts of the formulation components that produce a lubricant product that satisfies a plurality of product specifications.

Embodiment 18

The method of any of the above Embodiments, wherein the at least one first property and/or the at least one second property can correspond to a viscometric property, a volatility property, an oxidation stability property, a molecular weight distribution property, a fuel economy property, a dispersant-related property, a detergent-related property, or a combination thereof.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples.

Many variations will suggest themselves to those skilled in this art in light of the above detailed description. All such obvious variations are within the full intended scope of the appended claims.

What is claimed is:

1. A method for designing a lubricant blending component comprising:

identifying a plurality of lubricant products for formulation using a plurality of formulation components, the plurality of formulation components for each lubricant product including a first blending component;

selecting at least one first property of the first blending component;

varying the at least one first property of the first blending component to have a first plurality of selected values;

calculating a manufacturability index value for each of the plurality of lubricant products at each of the first plurality of selected values, wherein the value of a property $P_p$ for each of the plurality of lubricant products is expressed relative to the values $P_i$ for the property for each component i, present in an amount $X_i$ (wt %) according to Formula (1):

$$T(Pp)=\Sigma(i)[Xi*T(Pi)] \quad (1)$$

where T is any convenient functional form, such as a polynomial function, a logarithmic function, an exponential function, or a combination thereof, the calculated manufacturability index values for each of the plurality of lubricant products corresponding to a manufacturability window for each of the plurality of lubricant products;

determining an overlap between the manufacturability windows for each lubricant product; and formulating the plurality of lubricant products using the first blending component, the first blending component having a value for the at least one selected first property within the determined overlap of the manufacturability windows.

2. The method of claim 1, wherein the first blending component is selected from lubricant base stocks, viscosity modifiers, dispersants, detergents, pour point depressants, oil thickeners, polyisobutylenes, high molecular weight polyalphaolefins, antiwear/extreme pressure agents, antioxidants, demulsifiers, seal swelling agents, friction modifiers, corrosion inhibitors, antifoam additives, and combinations thereof.

3. The method of claim 1, further comprising:

selecting at least one second property of a second blending component; and varying the at least one second property of the second blending component to have a second plurality of selected values, the manufacturability index values being calculated at one or more of the second plurality of values for each of the first plurality of selected values.

4. The method of claim 1, wherein at least one of the first blending component and the second blending component comprises a lubricant base stock from a slate of base stocks.

5. The method of claim 1, wherein at least one of the first blending component and the second blending component comprises an additive.

6. A method for selecting a lubricant blending component, comprising:

identifying a plurality of lubricant products for formulation using a blending component from a family of blending components;

calculating a manufacturability index value for each of the plurality of lubricant products using each blending component from the family of blending components, wherein the value of a property $P_p$ for each of the plurality of lubricant products is expressed relative to the values $P_i$ for the property for each component i, present in an amount $X_i$ (wt %) according to Formula (1):

$$T(Pp)=\Sigma(i)[Xi*T(Pi)] \quad (1)$$

where T is any convenient functional form, such as a polynomial function, a logarithmic function, an exponential function, or a combination thereof;

selecting a blending component from the family of blending components based the calculated manufacturability index values; and formulating the plurality of lubricant products using the selected blending component.

7. The method of claim 6, wherein the family of blending components comprises a plurality of additives.

8. The method of claim 7, wherein the plurality of additives are viscosity modifiers, dispersants, detergents, or a combination thereof.

9. The method of claim 6, wherein the family of blending components comprises at least one lubricant base stock from a slate of lubricant base stocks.

10. The method of claim 6, wherein the family of blending components comprises a slate of lubricant base stocks.

11. The method of claim 6, wherein the manufacturability index value is based on a smaller number of dimensions than the region associated with manufacturability index.

12. The method of claim 6, wherein the manufacturability index value for at least one lubricant product has a value of at least 0.5 along each of at least two dimensions.

13. The method of claim 6, wherein the manufacturability index value for each lubricant product has a range value of at least 0.5 along each of at least two dimensions.

14. The method of claim 6, wherein the range value along each of at least two dimensions is normalized so that a range value of 1.0 corresponds to 1.0 wt % of a corresponding additional formulation component in a lubricant product.

15. The method of claim 6, wherein the at least one first property comprises a plurality of properties.

16. The method of claim 6, wherein the plurality of formulation components comprises at least 4 formulation components for at least one lubricant product.

17. The method of claim 6, wherein the manufacturability index value is a characteristic value corresponding to a region defined based on amounts of the formulation components that produce a lubricant product that satisfies a plurality of product specifications.

18. The method of claim 6, wherein the at least one first property and/or the at least one second property can correspond to a viscometric property, a volatility property, an oxidation stability property, a molecular weight distribution property, a fuel economy property, a dispersant-related property, a detergent-related property, or a combination thereof.

* * * * *